US005451834A

United States Patent [19]

Dho et al.

[11] Patent Number: 5,451,834

[45] Date of Patent: Sep. 19, 1995

[54] IN-LINE TYPE ELECTRON GUN FOR COLOR CATHODE RAY TUBE

[75] Inventors: Hansin Dho, Kyunggi-do; Neungyong Yeun, Seoul, both of Rep. of Korea

[73] Assignee: Samsung Electron Devices Co., Ltd., Kyunggi-do, Rep. of Korea

[21] Appl. No.: 981,753

[22] Filed: Nov. 25, 1992

[30] Foreign Application Priority Data

Dec. 6, 1991 [KR] Rep. of Korea ..... 91-22319

[51] Int. Cl.[6] ..... H01J 29/62

[52] U.S. Cl. ..... 313/414; 313/412

[58] Field of Search ..... 313/414, 412, 449, 460, 313/409, 452

[56] References Cited

U.S. PATENT DOCUMENTS 4,581,560 4/1986 Shirai et al. ..... 313/414
4,668,892 5/1987 Peels ..... 313/414
5,034,653 7/1991 Cho et al. ..... 313/449
5,142,189 8/1992 Sugahara et al. ..... 313/414
5,202,603 4/1993 Sugawara et al. ..... 313/414

FOREIGN PATENT DOCUMENTS 55-17963 2/1980 Japan .
58-103752 6/1983 Japan .

*Primary Examiner*—Sandra L. O'Shea
*Assistant Examiner*—Vip Patel
*Attorney, Agent, or Firm*—Christie, Parker & Hale

[57] ABSTRACT

An electron gun for use in a color picture tube which can reduce the astigmatism of main electron lenses and to make small circular beam spots. The electron gun has three cathodes each injecting an electron beam respectively and main electron lenses which concentrate the three electron beams onto a fluorescent screen, wherein a third electrode and a fourth electrode consisting the main electron lenses are formed by two large apertured electrodes facing each other and two small apertured electrodes each having three apertures for correcting the astigmatism.

2 Claims, 4 Drawing Sheets

IN-LINE TYPE ELECTRON GUN FOR COLOR CATHODE RAY TUBE

FIELD OF THE INVENTION

The present invention relates to an electron gun for use in a color picture tube, and particularly to an electron gun in which the large effective diameters of main electron lenses formed by the electric potential difference between a third electrode and a fourth electrode of the electron gun are formed, so that the main lens having minimized spherical aberration can be produced and small electron beam spots can be formed. Also, the present invention relates to an electron gun which can minimize the change of the focusing voltage according to that of the distance between a large apertured electrode and a small apertured electrode.

BACKGROUND OF THE INVENTION

FIG. 10 is a horizontal sectional view of a conventional in-line type color picture tube having a bipotential type electron gun. In this drawing, a fluorescent screen 2 is formed inside a faceplate 1 by applying fluorescent materials, and a shadow-mask 3 which allocates electron beams to the fluorescent screen 2 is installed at a predetermined distance from the fluorescent screen 2.

In the neck portion of the picture tube are installed three cathodes 4, 5, 6, a first electrode 10, a second electrode 11, a third electrode 12 and a fourth electrode 16 which form the main electron lenses, and a shielding cup 20, in serial arrangement. Each of the first electrode 10, the second electrode 11 and the third electrode 12 is provided with apertures corresponding to the cathodes 4, 5, 6, and the axes of these apertures coincide with that of the cathodes 4, 5, 6.

Inner cylinders 13, 14, 15 are installed on the right side of the third electrode 12 and inner cylinders 17, 18, 19 are installed on the left side of the fourth electrode 16. Among them, the axes of the inner cylinder 13, 14, 15 of the third electrode 12 coincide with the axes 7, 8, 9 of the cathodes respectively and the axis of a central inner cylinder 18 of the fourth electrode 16 also coincides with the axis 8 of the central cathode 5. However, the axes of the outer and inner cylinders 17, 19 of the fourth electrode are slightly deviated from the axes 7, 9 of the outer cathodes toward the outside, respectively.

The electron beams injected from the cathodes 4, 5, 6 proceed to the main electron lenses along the axes 7, 8, 9. Here, the electric potential of the third electrode 12 is lower than that of the fourth electrode 16, and the electric potential of the shielding cup 20 is the same as that of the fourth electrode 16.

The central apertures of the third and the fourth electrodes are coaxial with the central inner cylinders 14, 18. Because these inner cylinders prevent the influences arising from the nonsymmetry of the periphery of the electrode, the central main electron lens is of symmetrical shape. Accordingly, the central electron beam, i.e., the green beam is concentrated by the symmetrical main electron lens and proceeds straight along the axis 8. On the other hand, the outer main electron lenses are of nonsymmetrical shape because of the deviation of the axes of the outer and inner cylinders 17, 19 of the fourth electrode 16 from the axes of the outer inner cylinders 13, 15 of the third electrode 12. By this nonsymmetry each of the outer electron beams, i.e., the red beam, and the blue beam pass through the portions deviated from the axes of the center of the lenses at the divergence lens region formed by the fourth electrodes 16. These two beams are not only concentrated but are also deflected toward the central beam by the nonsymmetric main electron lenses thereby performing static converging of the three electron beams.

Thus, the converged electron beams reach the fluorescent screen 2 through the shadow-mask 3.

Among the factors that affect the focusing characteristic of the picture tube, are the magnification and aberration of the main electron lenses. These two factors are influenced by the concentration intensity of the lenses.

If focusing distance of the electron beam is kept constant, the magnification of the lens is lowered as the concentration intensity of the lens is weakened, and the angle of incidence declines as the spread of the beam inside the lens is confined to some extent in order to suppress enlargement of the deflection aberration.

If the concentration intensity of the lens is weakened, while the magnification of the lens and the spherical abberation is lowered, the focusing characteristic is improved. One of methods of weakening the concentration intensity is to enlarge the diameter of the inner cylinders corresponding to the apertures of the third electrode and the fourth electrode forming the main lens.

Generally, provided that the electric current or the luminance remains on the same level, the spherical aberration may be reduced in order to make the beam spot smaller. It can be shown from the equation:

$$D_T = \sqrt{(D_X + D_{SA})^2 + D_{SC}^2}$$

wherein $D_T$ represents the diameter of the beam spot on the fluorescent screen, $D_X$ represents the diameter of the beam spot which is determined by the magnification of the lens, $D_{SA}$ represents the spread of the beam spot diameter because of the spherical aberration, and $D_{SC}$ represents the spread of the beam spot diameter by the mutual repulsion of the space charge. From this equation it can be seen that the spread $D_{SA}$ of the beam spot diameter, because of the spherical aberration, affects the diameter $D_T$ of the beam spot on the fluorescent screen.

The effective diameters of the main electron lenses should be enlarged if the spherical aberration is to be reduced. However, there is an ultimate restriction on enlarging the diameter of the apertures on the third and the fourth electrodes in order to enlarge the effective diameters of the main electron lenses. As shown in FIG. 1, the main electron lenses of an in-line type electron gun each corresponding to the red, green and blue beams are all arranged in a line on the same plane. Thus, the diameter of the aperture of the electrode should be smaller than one third of the inside diameter of the neck portion which surrounds the electron gun.

A method for enlarging the diameter of apertures of the electrode is disclosed in Japanese Patent Laid-Open No. Sho-55-17963. According to this method, the diameters of apertures are set larger than the eccentric distance between the neighboring apertures, the overlapped portions by the apertures are communicated with each other, and partitioning plates are interposed between the apertures in order to correct the electric potential.

But this method also has a problem such that the diameter of the aperture L is limited by the equation:

$L=H-2S$ wherein H represents the horizontal (in the direction on which the apertures are arranged) length of the third electrode and S is represents as the eccentric distance between the neighboring apertures. In practice, problems arising from manufacturing the electrode render the value of the diameter of as described the aperture L smaller than the above.

An electrode structure, as shown in FIG. 11, proposed to accomplish the same effect as that obtained from the enlarging of the diameters of the aperture on the electrode is disclosed in another Japanese Patent Laid-Open No. Sho-58-103752.

This electrode structure, shown in FIG. 11, is provided with electrode plates 112, 122 inside the third electrode G3 and the fourth electrode G4, respectively, and recessed to the extent of $d_1$, and $d_2$ from their faces. Apertures 113, 113', 114, 123, 123', 124, formed on the electrode plates 112, 122, are of elliptical form with their major axes $a_1$, $a_2$ and their minor axes $b_1$, $b_2$. Inner cylinders such as those shown in FIG. 10 are not adapted in this structure.

By means of this electrode structure, a higher electric potential of the G4 electrode permeates G3 electrode and a lower electric potential of the G3 electrode permeates the G4 electrode, which results in the same effect as that obtained from enlarging the diameters of the apertures of the electrodes. Namely, this effect is equal to that obtained from enlarging effective diameters. Here, the apertures are of elliptical form to remove the astigmatism arising from the permeation of the electric potential that is stronger in the perpendicular direction than in the horizontal direction.

However, the problem of this electrode structure lies in manufacturing. The forming of the electrode plates 112, 122 within the outer electrodes 111 and 121 integrally respectively, as shown in FIG. 11, is not readily performed by a simple process such as a pressing process. Instead, it must undergo a complicated manufacturing process such as sintering the powdered electrode materials. The focusing characteristic is seriously influenced by the accuracy in the form of the apertures and the location of the electrodes, as will be explained later. Accordingly, the aforesaid manufacturing process must be followed by additional processes in order to ascertain the accuracy in the form of the apertures and the location of the electrodes as required. These complicated manufacturing processes act as a cost increasing factor, so that this electrode structure is not applicable to mass production.

In order to solve the above problem, in practice the electrode structure of FIG. 11 had to be reformed into the structure as shown in FIG. 12. The electrode structure of FIG. 12 can be formed by assembling the outer electrode 111' and the electrode 112', each separately fabricated by pressing processes. This reformed electrode structure is supposed to result in the same effect as that of the original electrode structure. However, even by using a jig, etc., for assembling the outer electrode 111' and the electrode 112', it is not easy to maintain the uniformity of the distance Df and to align the axes of the apertures with those of the cathodes. These difficulties again result in the problems of accuracy in the form of the apertures and the location of the electrodes as required.

SUMMARY OF THE INVENTION

To overcome the conventional problems, one object of the present invention is to provide main electron lenses of an electron gun in which the large effective diameters of the lenses are formed so as to provide the lenses having minimized spherical aberration which produce small electron beam spots.

Another object of the present invention is to provide an electrode structure which is easily manufactured and thus, can be mass produced.

To achieve these objectives, the present invention provides an electron gun for use in a color picture tube comprising three cathodes each injecting an electron beam and two electrodes serially arranged along the electron beam proceeding direction forming main electron lenses which concentrate the three electron beams onto a fluorescent screen, wherein the two electrodes include two large apertured electrodes facing each other with a predetermined gap between them and each having an aperture formed on the side facing each other through which all of the three electron beams can pass; and two small apertured electrodes each in contact with the large apertured electrodes at the opposite side to that facing each other, and each having three apertures surrounding one of the three electron beams and wherein distances between the apertured sides of the large apertured electrodes and the apertured sides of the small apertured electrodes are maintained at a predetermined magnitude.

The electrode structure according to the present invention can be particularly, mass produced by a relatively simple pressing process. By adapting the structure, the permeation of electric potential between the two electrodes becomes strong, which results in the same effect as that obtained from enlarging the diameters of the apertures on the electrodes. Namely, this effect is equal to that obtained from enlarging effective diameters of the main electron lenses. Hereinafter, from the two electrodes, the one which is nearer to the cathodes is referred to as a third electrode and the other which is farther from the cathodes is called a fourth electrode.

In the above electrode structure, the apertures of the large apertured electrodes are of noncircular form which make vertical (perpendicular to the aperture arraying direction) beam concentration intensities and horizontal beam concentration intensities different from each other. Thus, the vertical effective diameters and the horizontal effective diameters of the main electron lenses are different from each other, too. This is one cause of astigmatism. However, the difference in beam concentration intensities can be rectified by adjusting the height of the large apertured electrode or the height of the small apertured electrode thereby adjusting the distance between the apertured side of the large apertured electrode (hereinafter referred to as the large apertured side) and the apertured side of the small apertured electrode (hereinafter referred to as the small apertured side).

However, if the distance between each of the apertured sides is too far, the converging of the electron beams by the main electron lenses becomes worse. In this case, it is possible to equalize the vertical effective diameters of the main electron lenses with the horizontal effective diameters of the same by forming the apertures of the small apertured electrodes in a noncircular form.

That is, it is possible to make the vertical electric potential of the third electrode higher than the horizontal electric potential of the same by forming the horizontal length of the apertures of the third electrode shorter than the vertical length of the same. Thus, the horizontal and vertical concentration intensities of the main electron lens can be equalized and the astigmatism can be removed.

Also, if the vertical length of apertures of the small apertured electrode of the fourth electrode become longer than the horizontal length of the same, the diverging power of the electron beams in the vertical direction become stronger than ever and the cross-sectional shape of the electron beams can be improved so that it is possible to remove the astigmatism.

The above variations of the form of the apertures on the third electrode and the fourth electrode can be used either independently or dependently.

BRIEF DESCRIPTION OF THE DRAWINGS

The above objects, features and advantages of the present invention will become apparent from the following description regarding the preferred embodiments of the present invention, taken in conjunction with the accompanying drawings, in which.

DESCRIPTION OF THE PREFERRED EMBODIMENTS

Figure 1:
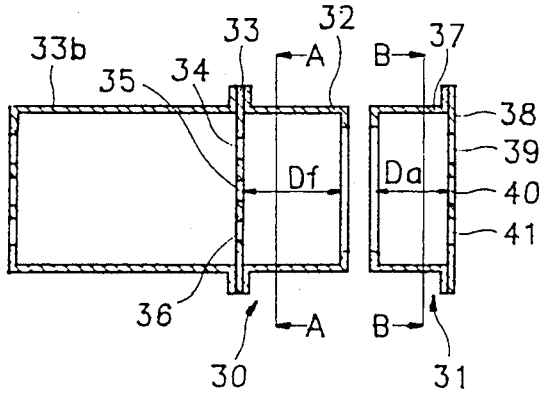
FIG. 1 is a horizontal sectional view of the main part of an electron gun according to the present invention.
Figure 2A:
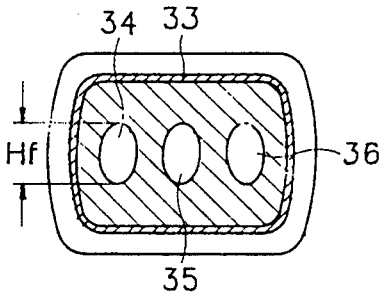
FIG. 2A and FIG. 2B are cross-sectional views taken along lines A—A and B—B in FIG. 1, respectively.
Figure 2B:
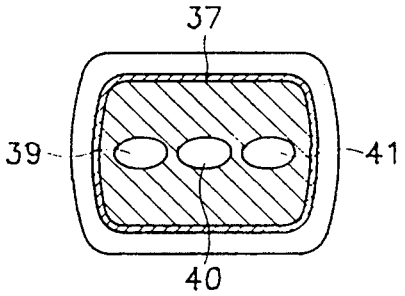

FIG. 1 is a horizontal sectional view of the main part of an electron gun according to the present invention, and FIG. 2A and FIG. 2B are cross-sectional views taken along lines A—A and B—B in FIG. 1, respectively, showing a bipotential type main electron lens.

Figure 3:
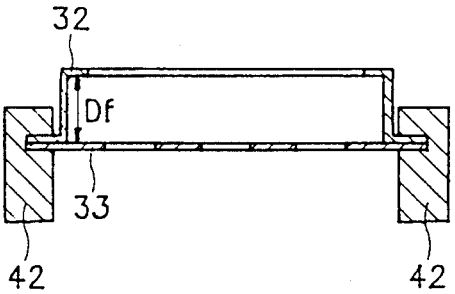
FIG. 3 to 5 are cross-sectional views of electrodes of the electron gun according to the preferred embodiments of the present invention.
Figure 4:
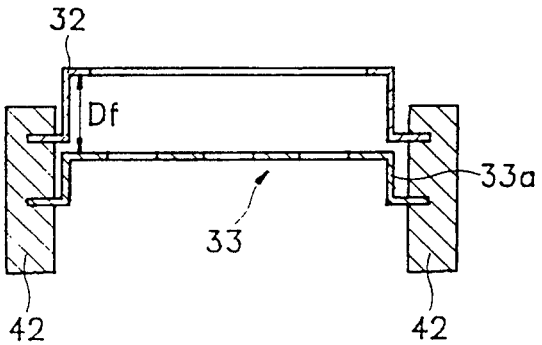
Figure 5:
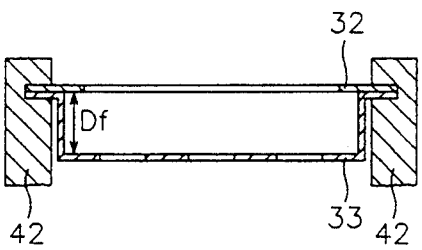

A third electrode indicated as reference numeral "30" and a fourth electrode indicated as reference numeral "31" are serially arranged along the electron beam and that proceed in a direction at a predetermined distance from each other and are welded to bead glasses 42 (though not shown in FIG. 1, the bead glasses correspond to the hatched portions in FIG. 3 to 5). Cathodes of the electron gun which is not shown in FIG. 1 is arranged on the left of the third electrode 30.

The third electrode 30 is divided into three parts 32, 33, 33*b*. Represented is a large apertured electrode 32 and a small apertured electrode 33. The large apertured electrode 32 has an aperture which surrounds all three electron beams. The small apertured electrode 33 has three apertures 34, 35, 36 which surround the electron beams, respectively. The form of the aperture may be of a circular form or another form wherein, as shown in FIG. 2A, the vertical length of the aperture is longer than the horizontal length of the same.

Here, the aperture of the large apertured electrode is of noncircular form, so that the vertical effective diameter of the main electron lenses is not the same as the horizontal effective diameter of the same. As a result, the permeation of the horizontal electric potential become stronger than that of the vertical electric potential so as to cause astigmatism. When the apertures 34, 35, 36 of the small apertured electrode are of circular form, it is possible to adjust the distance Df between the large apertured side and the small apertured side to remove such difference of the effective diameters of the main electron lenses and the astigmatism.

As shown in FIG. 2A, if the vertical length of the apertures 34, 35, 36 is longer than the horizontal length of the same, it is possible to equalize the vertical effective diameter and the horizontal effective diameter of the main electron lenses to remove the astigmatism without an excessively long setting for the distance Df excessively long.

The fourth electrode 31 is divided into two parts 37, 38. The reference numeral 37 indicates a large apertured electrode which is arranged opposite the large apertured electrode 32 of the third electrode 32 and the reference numeral 38 indicates a small apertured electrode. All three electron beams pass through the large apertured electrode 37. So, the large apertured electrode 37 has an aperture surrounding all of the three electron beams. The three electron beams pass through the three small apertured electrode 38, respectively. So, the apertures of the three apertured electrodes 39, 40, 41 each surround the electron beams. The form of the three apertures may be of a circular form or another form wherein, as shown in FIG. 2B, the horizontal length of the apertures is longer than the vertical length of the same.

By forming the horizontal length of the apertures 39, 40, 41 longer than the vertical length of the same, the vertical diverging power of the electron beams which pass through the apertures can be stronger than ever and the cross-sectional shape of the electron beam can be improved.

Figure 6:
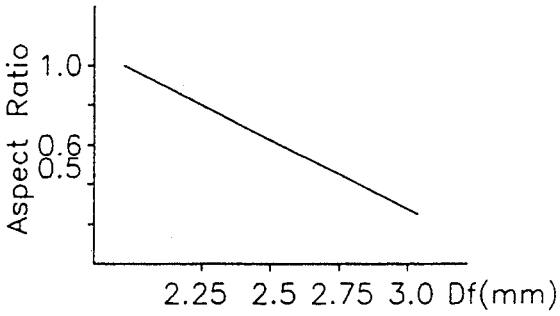
FIG. 6 is a graph showing the relationship between the distance Df between the large apertured side and the small apertured side of the third electrode in FIG. 1 and the ratio between the vertical magnitude and the horizontal magnitude (hereinafter referred to as aspect ratio) of the beam spot.

FIG. 6 is a graph showing the relationship of the distance Df between the large apertured side and the small apertured side of the third electrode and the aspect ratio of the beam spot. This graph reads: as Df gets longer, the horizontal length of the beam spots gets longer also.

Figure 7:
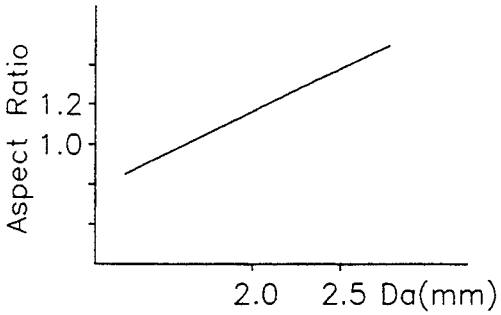
FIG. 7 is a graph showing the relationship between the distance Da between the large apertured side and the small apertured side of the fourth electrode in FIG. 1 and the aspect ratio of the beam spot.

FIG. 7 is a graph showing the relationship between the distance Da between the large apertured side and the small apertured side of the fourth electrode and the aspect ratio of the beam spots. This graph reads: as Da gets longer, the vertical length of the beam spots gets longer also.

Figure 8:
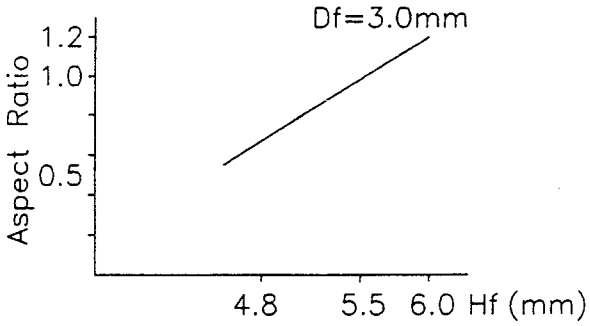
FIG. 8 is a graph showing the relationship between the vertical length Hf of the apertures in the small apertured electrode and the aspect ratio of the beam spot.

Also, FIG. 8 is a graph showing the relationship between the vertical length Hf of the apertures in the small apertured electrode and the aspect ratio of the beam spots when Df is 3.0 mm. This graph reads: as Hf gets longer, the vertical length of the beam spots gets longer also.

Figure 9:
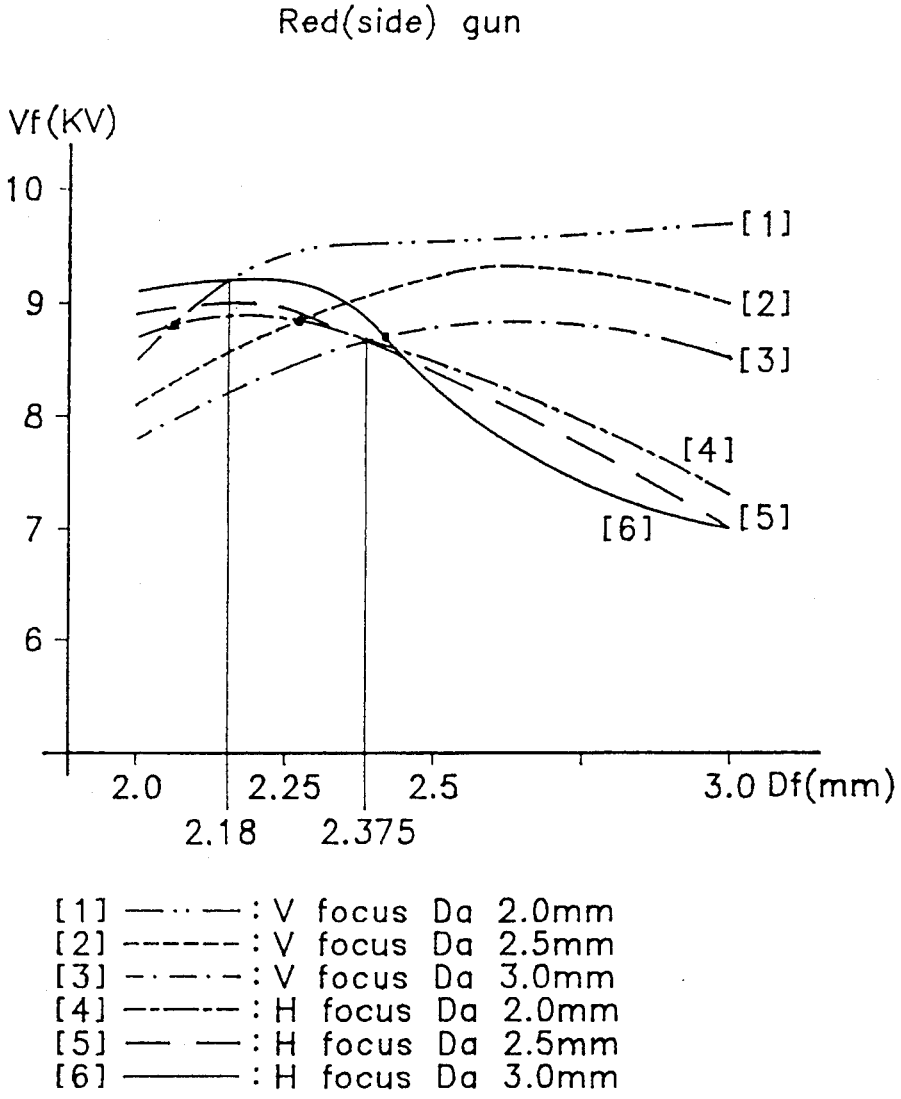
FIG. 9 is a graph showing the relationship between the distance Df and the focusing voltage Vf when vertically focused or horizontally focused with constant values of Da.
Figure 10:
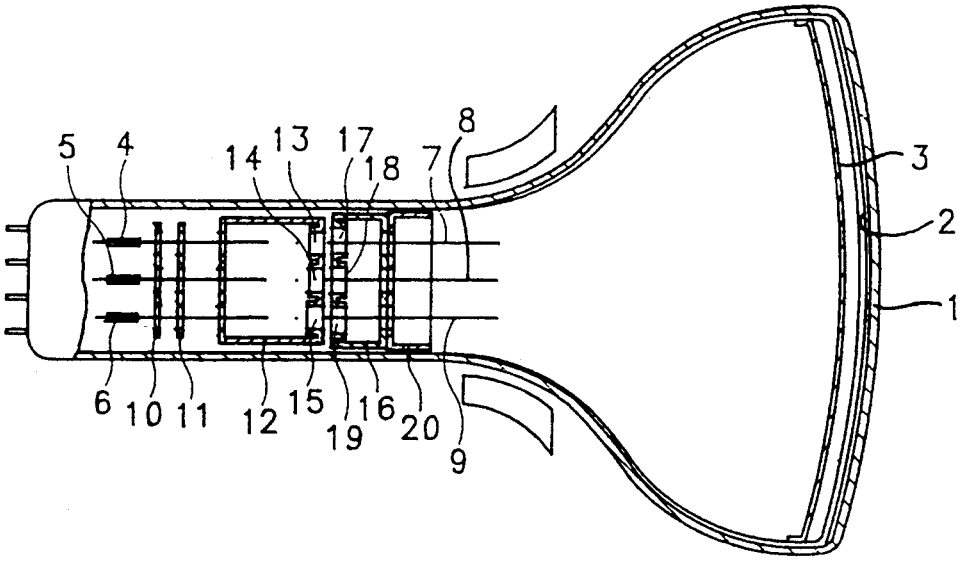
FIG.10 (Prior Art)
FIG. 10 is a schematic horizontal sectional view of a conventional electron gun for use in an in-line type color picture tube.
Figure 11A:
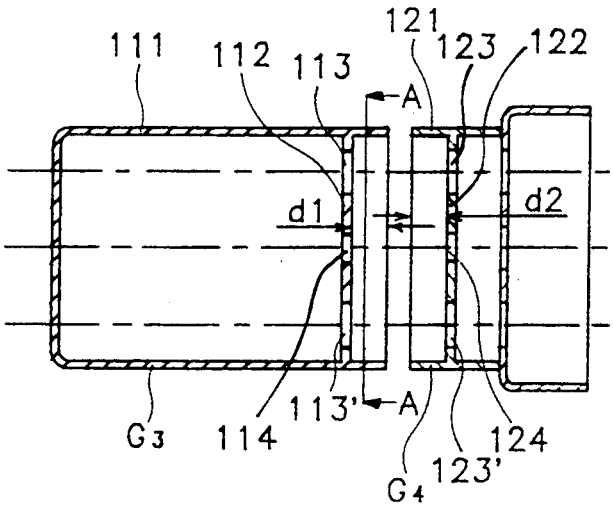
FIG.11A (Prior Art)
FIG. 11 includes FIG. 11A which is a horizontal sectional view of the electrode structure of another conventional electron gun.
FIG. 11B shows a section view taken along the lines of AA of FIG. 11A.
Figure 11B:
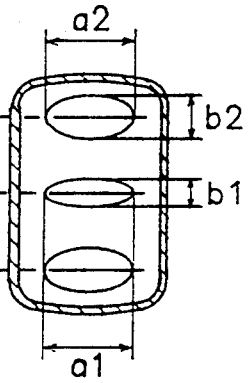
FIG.11B (Prior Art)
Figure 12:
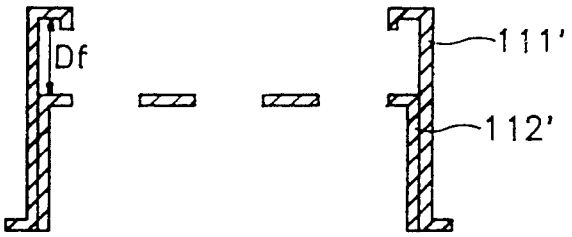
FIG.12 (Prior Art)
FIG. 12 is a cross-sectional view of a reformed electrode structure of the conventional electron gun of FIG. 11.

FIG. 9 is a graph showing the relationship between the distance Df and the focusing voltage Vf when vertically focused or horizontally focused with constant values of Da for the case of red electron gun (a side electron gun). In this graph, curve [1] shows the changing state of Vf according to the change of Df when vertically focused at Da of 2.0 mm. Also, curve [2], [3] show the changing states of Vf according to the changes of Df when vertically focused at Da of 2.5 mm, Da of 3.0 mm respectively, and curves [4], [5], [6] show the changing states of Vf according to the changes of Df when vertically focused at Da of 2.0 mm, Da of 2.5 mm, Da of 3.0 mm, respectively.

Coordinates of the curve [1] read: according to the change of Df value from 2.0 mm to 2.18 mm, the approximate value of Vf is changed from 8.5 KV to 9.2 KV. This means that the vertical focusing voltage should be raised by about 700 Volts in order to meet the height of the third electrode increased by 0.18 mm. From this result, it can be concluded that the accuracy in the value of Df greatly affects the vertical focusing voltage and the focusing characteristic. It is implied that the change of Da value also has a similar effect even though this curve does not directly read so.

In practice, because the vertical focusing and the horizontal focusing must be carried out simultaneously, the values of Df and Vf are determined by the coordinates of the points at which the curves [1] and [4], [2] and [5], and [3] and [6] meet, respectively. This is because the beam spots become a circle only when the vertical focus and the horizontal focus coincide with each other.

As described above, accuracy in the form of the apertures and in the respective location of the large apertured side and the small apertured side, i.e., the distances Df, Da between them affect the focusing characteristic, etc. FIGS. 3 to 5 show the preferred embodiments of the present invention respectively, which can be applied to either the third electrode or the fourth electrode. The electrode structure of these embodiments can be manufactured with the high accuracy in the form of the apertures and the distances Df, Da between the electrodes. Also, it can be manufactured by a relatively simple process, e.g., a pressing process.

FIG. 3 shows that when the large apertured electrode 32 is of a cup shape and the small apertured electrode 33 is of a plate shape. This construction has the advantage of keeping the distances Df and Da constant. FIG. 5, in contrast with the case of FIG. 3, shows another case when the large apertured electrode 32 is of a plate shape and the small apertured electrode 33 is of a cup shape. The case, as shown in FIG. 4, is such that both of the electrodes 32, 33 are of the cup shape.

The advantages obtained during the manufacturing of the cup-shaped electrode are such that the applicability of dies for electrodes is good when the distance Df or Da is changed according to some design changes; it is easy to assemble the parts of the electrode; and the deformation of the electrode is minimized during welding of the electrode to the bead glasses 42. Also, in order to minimize deformation of the electrode and deterioration of the characteristic of the electron gun, the thickness of the electrode material is preferably 0.4 mm to 0.6 mm.

Generally, in an electron gun using the large apertured electrodes, the focusing voltage of the central main electron lens is lower than that of the side main electron lenses. This means that, in order that the three electron beams have the same beam characteristics, the central aperture should be smaller than the side apertures of the small apertured electrodes.

What is claimed is:

1. An electron gun for use in a color picture tube comprising three cathodes, each cathode injecting an electron beam and two electrodes serially arranged along the electron beam proceeding direction forming main electron lenses which concentrate the three electron beams onto a fluorescent screen, wherein the two electrodes include two large apertured electrodes facing each other with a predetermined gap between them and each having an aperture formed on the side facing each other through which all of the three electron beams can pass; and two small apertured electrodes, each small apertured electrode contacted to the respective large apertured electrodes at the opposite side to that facing each other and having three apertures, each aperture surrounding one of the three electron beams and wherein distances between apertured sides of the large apertured electrodes and apertured sides of the small apertured electrodes are maintained at a predetermined magnitude, and wherein the large apertured electrode of one of the two electrodes forming the main lenses is of a plate shape and the small apertured electrode of the same is of a cup shape.

2. An electron gun for use in a color picture tube comprising:

a plurality of cathodes for injecting a plurality of substantially circular electron beam 8 on a path toward a fluorescent screen; and a main electron lens located within the path for receiving the substantially circular beam and preventing astigmatism from forming within the lens, comprising:

a plurality of large-apertured electrodes along the electron beam path, each having a single large oblong aperture surrounding the plurality of electron beams; and a plurality of small-apertured electrodes coupled to the large-apertured electrodes and having a plurality of small oblong apertures corresponding to each individual electron beam, wherein the large apertured electrode of one of the two electrodes forming the main lens is of a plate shape, and the small apertured electrode of the same is of a cup shape.

* * * * *